US006709571B1

(12) United States Patent
Del Rossi et al.

(10) Patent No.: US 6,709,571 B1
(45) Date of Patent: Mar. 23, 2004

(54) LOW PRESSURE NAPHTHA HYDROCRACKING PROCESS

(75) Inventors: Kenneth J. Del Rossi, Victoria (AU); David A. Pappal, Haddonfield, NJ (US); Brenda H. Rose, Tokyo (JP)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/357,504

(22) Filed: Jul. 20, 1999

Related U.S. Application Data

(63) Continuation-in-part of application No. 08/964,269, filed on Nov. 3, 1997, now abandoned.

(51) Int. Cl.[7] ..... C10G 47/00; C10G 45/00

(52) U.S. Cl. ..... 208/111.35; 208/111.01; 208/111.3; 208/209; 208/254 R

(58) Field of Search ..... 208/111.01, 111.3, 208/111.35, 209, 254 R

(56) References Cited

U.S. PATENT DOCUMENTS

| | | | | |
|---|---|---|---|---|
| 3,468,788 A | | 9/1969 | Wilkinson | 208/89 |
| 3,660,270 A | | 5/1972 | Mason | 208/59 |
| 3,702,818 A | | 11/1972 | Streed et al. | 208/89 |
| 3,779,897 A | * | 12/1973 | Wrench et al. | 208/89 |
| 3,929,620 A | | 12/1975 | Parthasarathy et al. | 208/111 |
| 4,968,402 A | * | 11/1990 | Kirker et al. | 208/68 |
| 5,378,671 A | * | 1/1995 | Keville et al. | 502/64 |
| 5,399,258 A | * | 3/1995 | Fletcher et al. | 208/89 |

* cited by examiner

*Primary Examiner*—Walter D. Griffin
*Assistant Examiner*—Tam M. Nguyen
(74) *Attorney, Agent, or Firm*—Gerard J. Hughes; Estelle C. Bakun

(57) ABSTRACT

This invention is directed to an extinction recycle naphtha hydrocracking processes. Large pore zeolite catalysts with Constraint Indices less than 2, such as USY or beta, which are loaded with noble metals such as Pt or Pd or with transition metals such as Ni in combination with Mo or W are employed. Preferably, low hydrogen partial pressures, and a feedstock relatively rich in hydrogen and low in aromatics content, are used, in order to extend catalyst cycle length.

9 Claims, 3 Drawing Sheets

Process Flow Diagram

Figure 1. Process Flow Diagram

Figure 2. Catalyst Aging Study

Low Pressure Extinction Recycle of Raw FCC Heavy Naphtha

LOW PRESSURE NAPHTHA HYDROCRACKING PROCESS

CROSS REFERENCE TO RELATED APPLICATIONS

This application is a continuation-in-part of application Ser. No. 08/964,269, filed Nov. 3, 1997, now abandoned.

FIELD OF THE INVENTION

This invention is directed to naphtha, kerosene or diesel hydrocracking processes employing large pore zeolite catalysts such as Zeolite Beta or Ultra Stable Y (USY), which are loaded with noble metals such as Pt or Pd or with transition metal such as Ni in combination with Mo or W. Preferably, low hydrogen partial pressures and feedstocks relatively rich in hydrogen and low in aromatics are employed, in order to extend catalyst cycle length.

BACKGROUND

Many refineries have been required to reduce the $T_{90}$ (temperature at which 90% of the gasoline pool boils as measured by an atmospheric distillation such as ASTM D-86) of the gasoline pool in order to meet more stringent governmental regulations being enacted in some areas. This requires removal of heavy feeds, such as FCC gasoline, from the gasoline pool. Such heavy feeds then enter the kerosene market, potentially forcing the price of kerosene to drop. It is therefore desirable to find new uses for FCC gasoline and kerosene, boiling in the range from 300° to 400° F. The process of the instant invention will enable refineries to convert these feeds to gasolines which meet the criteria of governmental entities such as the EPA and CARB.

Catalysts comprising large pore zeolites loaded with metals combinations such as Ni—Mo or Ni—W have been previously employed in hydrocracking applications. U.S. Pat. No. 5,401,704 (Absil et al., hereafter Absil) discloses a hydrocracking process employing a catalyst comprising small crystal zeolite Y. Preferred feeds possess at least 70 wt. % hydrocarbons having a boiling point of at least 400° F. Lighter feeds are desired in the instant invention. Zeolite Y may be loaded with a metal or combinations of metals for hydrogenation purposes, such as Pt, Pd, Ni—W or Co—Mo. Absil does not, however, teach the concept of extinction recycle hydrocracking at hydrogen partial pressures below 400 psig, as does the instant invention.

U.S. Pat. No. 5,500,109 (Keville et al., hereafter Keville #1) discloses a hydrocracking catalyst which comprises a large pore zeolite (such as USY) loaded with metals combinations such as NiW. This catalyst is extruded with an alumina binder. The disclosure suggests, however, that feeds intended for use with this catalyst are gas oils and residua, rather than the lighter feeds of the instant invention. There is also no mention of extinction recycle hydrocracking.

U.S. Pat. No. 5,378,671 (Keville et al., hereafter Keville #2) is also directed to hydrocracking of gas oils and residua with catalysts comprising large pore zeolites.

U.S. Pat. No. 4,968,402 discloses a process for producing high octane gasoline from heavy feedstocks containing over 50 wt. % aromatics such as polynuclear aromatics. A catalyst comprising MCM-22 is employed, preferably loaded with NiW.

U.S. Pat. No. 4,851,109 discloses a two-stage process for hydrocracking feeds such as coker gas oils, vacuum gas oils, as well as light and heavy cycle oils. In the first stage, the feed is hydrocracked with a catalyst comprising a large pore zeolite, such as zeolite Y or USY. The catalyst may be loaded with a hydrogenation component such as a NiW combination. In the second stage, hydroprocessing occurs over a catalyst comprising zeolite beta.

U.S. Pat. No. 3,923,641 to Morrison and U.S. Pat. No. 4,812,223 to Hickey, Jr. et al. teach the conversion of $C_5^+$ and $C_6^+$ naphthas over noble metal-containing zeolite Beta catalyst, preferably a steamed zeolite Beta catalyst. There is no mention of extinction recycle hydrocracking.

U.S. Pat. No. 4,968,403 to Kirker et al is primarily directed to upgrading hydrocarbons employing a catalyst comprising MCM-22, which is loaded with base metals. There is only a general teaching of recycling bottoms to the hydrocracker. Feeds having an aromatic content of over 75 wt. % are suitable for use in Kirker, whereas in the instant invention, aromatics content is to be no greater than 40 wt. % if the catalyst is loaded with base metals. Kirker teaches away from the use of USY, whereas USY is the preferred zeolite in the instant invention.

SUMMARY

A large pore zeolite cracking catalyst, loaded with noble metals such as Pt or Pd or with a transition metal such as Ni, in combination with a non-noble metal such as molybdenum or tungsten, is employed in a process to convert heavy naphtha, kerosene or diesel fractions (300° to 900° F. endpoint) to lower boiling naphtha fractions, having a 300° F. endpoint. The process is conceived to operate at hydrogen partial pressures in the range of 200 to 1000 psig, preferably between 300 to 540 psig, with up to fill conversion of the heavy fraction by means of extinction recycle.

Large pore zeolite catalysts comprising noble metal or non-noble metals combinations have been considered to be unstable for extinction recycle hydrocracking at low hydrogen partial pressures. The instant invention demonstrates, however, that such catalysts may be used.

DESCRIPTION OF THE PREFERRED EMBODIMENT

Figure 1:
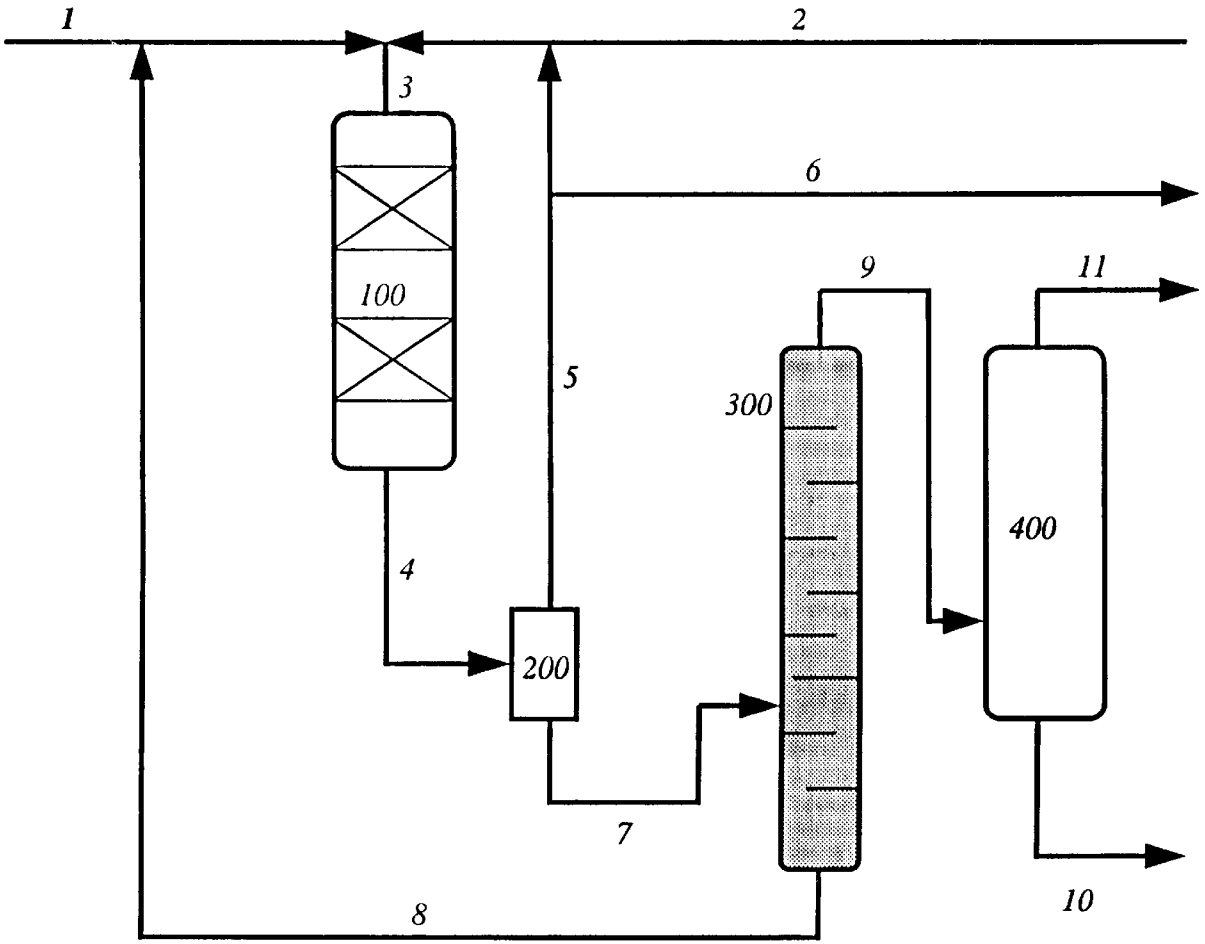
FIG. 1 is a process flow diagram of the preferred embodiment of the instant invention.

The low pressure hydrocracking process of the instant invention is illustrated in FIG. 1. Fresh feed enters through line 1. The fresh liquid feed is specified to contain hydrogen and (i.e., sulfur, nitrogen and oxygen) to be consistent with the choice of catalyst metal function and the desired product properties. The boiling range for the feed is 250° to 900° F. The endpoint specification for the feed is 400° to 850° F. Liquid feed is mixed with hydrogen gas entering from line 2, and the mixture enters reactor 100 via line 3. The mixture is distributed over at least two beds of packed catalyst particles in reactor 100. Additional gas and liquid may be injected between catalyst beds (as a quench) to control reactor temperature. Total pressure in reactor 100 can range from 300 to 1500 psig, and hydrogen partial pressure will range from 200 to 1000 psig. Reactor temperatures are adjusted to give the desired level of boiling point conversion, but will typically range from 4500 to 850° F.

The effluent from reactor 100 enters the gas-liquid separator 200 via line 4 . Liquid product is drawn from the bottom of the separator and sent via line 7 to splitter column 300. Hydrocarbons boiling below 300° F. go overhead in splitter column 300, and higher boiling components are taken from the bottom and recycled. The recycle liquid is sent through line 8 and mixed with fresh feed. If desired, a portion of the recycle liquid may be withdrawn as a product stream, producing a product of higher quality than the feed. In the event that the catalyst generates significant quantities of C4-compounds, a stabilizer column can be inserted in the process flow prior to splitter 300. The embodiment depicted in FIG. 1 shows the overhead from splitter column 300 passing through line 9 to stabilizer 400. Product naphtha with a 300° F. endpoint is drawn from the bottom of the stabilizer (line 10), and C4- is taken overhead (line 11).

Gas in the reactor effluent is taken from the top of separator 200 via line 5 and recycled back to reactor 100. Recycle gas is mixed with fresh hydrogen make-up gas from line 2 to control hydrogen purity. This is particularly important if significant quantities of methane and ethane are generated in the process. The recycle gas rate will range from 4000–12,000 SCF/bbl of feed. Hydrogen purity in the recycle gas should be maintained above about 75 mol %.

DETAILED DESCRIPTION OF THE INVENTION

Feed

The feed to this process comprises a heavy naphtha, kerosene, or diesel characterized by a boiling range of $C_{11}$ to $C_{15}$ (approximately 200° to 900° F. more preferably 300° to 800° F.). Sources of this feed include straight run naphtha, hydrocracked naphtha, pretreated reformer feed, fluid catalytically cracked (FCC) naphtha, heavy naphtha or light cycle oil feed, coker naphtha, coker kerosene, or coker gas oil. The choice of the preferred catalyst metal function is dependent on the quality of the feedstock processed and the desired product quality. Noble metal catalyst formulations are preferred for clean feeds, while base metal catalyst formulations are preferred for feedstocks containing high levels of heteroatoms or for operations where higher hydrocracked product octanes are desired.

For the noble metal loaded catalysts the aromatics content of the feed should be no greater than 30 wt. %, and the naphthenic content between 40 and 70 wt. %. The range of API gravity for the feed is between 25 and 50. Since a total hydrogen content above about 13.0 wt. % and a total heteroatom level below 500 ppmw is required, it may be necessary to hydrotreat the feed prior to hydrocracking according to the instant invention. Total hydrogen is defined as the sum of hydrogen in the gas and liquid feeds minus the amount of hydrogen predicted to be consumed by sulfur and nitrogen as hydrogen sulfide and ammonia, respectively, expressed as weight percent of the feed.

For the base-metal loaded catalysts the aromatics content of the feed should be no greater than 40 wt. %, and the naphthenic content between 30 and 60 wt. %. The range of API gravity for the feed is between 25 and 50. Since base metal catalysts can tolerate elevated levels of heteroatoms, pretreatment of the feed is not required. In this case the total heteroatom content should be less than about 2 weight percent.

Feedstocks suitable for low pressure hydroconversion are heavy naphtha, kerosene or diesel from a single stage or two-stage hydrocracking process or cracked naphthas which have been subjected to hydrotreating at conditions that will meet the feedstock quality, such as pretreated FCC naphtha, kerosene or light cycle oil, coker naphtha, or gas oil.

If it is necessary to hydrotreat the feed, conventional hydrotreating catalysts and conditions may be employed. The hydrotreating catalyst typically comprises a base metal hydrogenation function on a relatively inert, i.e., non-acidic porous support material such as alumina, silica or silica alumina. Suitable metal functions include the metals of Groups VI and VIII of the Periodic Table, preferably cobalt, nickel, molybdenum, vanadium and tungsten. Combinations of these metals such as cobalt-molybdenum and nickel-molybdenum will usually be preferred. Operating conditions of liquid hourly space velocity (LHSV), hydrogen circulation rate and hydrogen pressure will be dictated by the requirements of the hydrocracking step, as described below. Temperature conditions maybe varied according to feed characteristics and catalyst activity in a conventional manner.

Reference is made to U.S. Pat. No. 4,738,766 for a more detailed description of suitable hydrotreating catalysts and conditions which may also be suitably employed in the present process.

Catalyst

The preferred hydrocracking catalysts for use in the present process are the zeolite catalysts, comprising a large pore size zeolite, usually composited with a binder.

The large pore size zeolites such as zeolites X, Y, and Beta are preferred in order to effect the desired conversion of naphthenes and aromatics in the feeds to produce the aromatic, high octane gasoline product.

Suitable hydrocracking catalysts include those solids having relatively large pores which exhibit both acid and hydrogenation functions. The acid function is therefore suitably provided by a large pore size aluminosilicate zeolite characterized by a Constraint Index of less than 2, examples of which include mordenite, TEA mordenite, zeolite X, zeolite Y, ZSM-4, ZSM-12, ZSM-20, ZSM-38, ZSM-50, REX, REY, USY and Beta. The zeolites may be used in certain of their various forms, for example, certain of their cationic forms, preferably cationic forms of enhanced hydrothermal stability. For example, rare earth exchanged large pore zeolites such as REX and REY are generally preferred, as are the ultra-stable zeolite Y (USY) and high silica zeolites such as dealuminized Y or dealuminized mordenite of beta.

An especially preferred hydrocracking catalyst is based on the ultra-stable zeolite Y (USY) with base metal hydrogenation components selected from Groups VIA and VIIIA of the Periodic Table (IUPAC Table). Combinations of Groups VIA and VIIIA metals are especially favorable for hydrocracking, for example nickel-tungsten, nickel-molybdenum, et al. Other useful hydrocracking catalysts comprise USY or beta composited with noble metals.

A more extensive and detailed description of suitable catalysts for the present process may be found in U.S. Pat. Nos. 4,676,887; 4,738,766 and 4,789,457 to which reference is made for a disclosure of useful hydrocracking catalysts.

A convenient measure of the extent to which a zeolite provides control to molecules of varying sizes to its internal structure is the Constraint Index of the zeolite. The method by which Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as if set forth at length herein.

The above-described Constraint Index provides a definition of those zeolites which are useful in the instant invention. The very nature of this parameter and the recited technique by which it is determined, however, admit the possibility that a given zeolite can be tested under somewhat different conditions and thereby exhibit different Constraint Indices. Constraint Index seems to vary somewhat with the severity of operations (conversion) and the presence or absence of binders. Likewise, other variables, such as crystal size of the zeolite, and the presence of occluded contaminants, etc. may affect the Constraint Index. Therefore, it will be appreciated that it may be possible to so select test conditions, e.g. temperature as to establish more than one value for the Constraint Index of a particular zeolite. This explains the range of Constraint Indices for some zeolites, such ZSM-5, ZSM-11 and Beta.

The hydrogenation function is provided by a metal or combination of metals. Noble metals of Group VIIIA of the Periodic Table, especially platinum or palladium may be used, as may base metals of Groups IVA, VIA, and VIIIA, especially chromium, molybdenum, tungsten, cobalt and nickel. Combinations of metals such as nickel-molybdenum, cobalt-molybdenum, cobalt-nickel, nickel-tungsten, cobalt-nickel-molybdenum, and nickel-tungsten-titanium can be effective. The non-noble metals are often used in the form of their sulfides.

In practicing conversion processes using the catalyst of the present invention, it may be useful to incorporate the above-described crystalline zeolites with a matrix comprising another material resistant to the temperature and other conditions employed in such processes. Such matrix materials include synthetic or naturally occurring substances as well as inorganic materials such as, clay, silica and/or metal oxides, most notably alumina oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and kaolins commonly known as Dixie, McNamee-Georgia and Florida clays or others in which the main mineral constituent is halloysite, kaolinite, dickite, nacrite or anauxite. Such clays can be used in the raw state or initially subjected to calcination, acid treatment or chemical modification.

In addition to the foregoing materials, the zeolites employed herein may be composited with a porous matrix material, such as alumina, silica, silica-alumina, silica-magnesia, silica-zirconia, silica-thoria silica-beryllia, and silica-titania, as well as ternary compositions such as silica-alumina-thoria, silca-alumina-zirconia, silica-alumina-magnesia and silica-magnesia-zirconia. The matrix may be in the form of a cogel. The relative proportions of zeolite component and inorganic oxide gel matrix, on an anhydrous basis, may vary widely with the zeolite content ranging from between 1 to 99 percent and more usually in the range of about 40 to 90 percent by weight of the dry composite.

Additional catalyst modifying procedures which may also optionally be employed to modify the activity or selectivity include precoking and presteaming or combination thereof Presteaming, preferably conducted at 400–800° C. for 0.25–24 hours and with 10 to 100% steam, generally alters zeolite catalyst activity and selectivity.

The noble metals useful in the hydrocracking catalyst include platinum, palladium, and other Group VIIIA metals such as iridium and rhodium with platinum or palladium preferred as noted above.

The noble metal may be incorporated into the catalyst by any suitable method such as impregnation or exchange the zeolite. The noble metal my be incorporated in the form as cationic, anionic or neutral complex such as $Pt(NH_3)_4^{2+}$, and cationic complexes of this type will be found convenient for exchanging metals into the zeolite. The amount of noble metal is suitably from about 0.01 to about 10 percent by weight, normally from about 0.1 to about 2.0 percent by weight. In a preferred method of synthesizing Pt-containing zeolite Beta or USY the platinum compound is tetraamine-platinum hydroxide. The noble metal is preferably introduced into the catalyst composition with a pH near-neutral solution.

A high level of noble metal dispersion is preferred. For example, platinum dispersion is measured by the hydrogen chemisorption technique and is expressed in terms of H/Pt ratio. The higher the H/Pt ratio, the higher the platinum dispersion. Preferably the resulting catalyst should have a H/Pt ratio greater than about 0.7.

Conditions

The hydrocracking conditions employed in the present process are generally those of low hydrogen pressure and moderate hydrocracking severity. Hydrogen pressure reactor inlet) is maintained from about 300 to 1000 psig. Hydrogen circulation rates of between 2000 to 10000 SCF/Bbl, more usually between 3000 to 7000 SCF/Bbl are suitable, with additional hydrogen supplied as quench to the hydrocracking zone, usually in comparable amounts. Space velocity is between 1 and 2 LHSV.

Temperatures are maintained usually in the range of about 450° F. to about 850° F., and more usually will be in the range of about 475° to 800° F. A more preferred operating range is about 5000 to 775° F. Thus, the selected temperature will depend upon the catalyst formulation employed, the character of the feed, hydrogen pressure employed and the desired conversion level.

Conversion is maintained at relatively moderate levels and, as noted above, will usually not exceed about 60 wt. % to gasoline boiling range material per pass. Since extinction recycle is employed, however, the feed will ultimately be totally converted to materials boiling below 300° F. Alternatively, a portion of the liquid recycle may be withdrawn to produce a product of higher quality than the feedstock.

EXAMPLES

Laboratory Data

The proposed process was demonstrated using a laboratory pilot unit equipped with an on-line still, and gas recycle system.

The support of Catalyst A comprises 65 wt. % USY and 35 wt. % alumina binder. Catalyst A is loaded with Ni—W, as described in U.S. Pat. No. 5,219,814. The alpha value is 25.45.

The support of Catalyst B comprises 65 wt. % zeolite beta and 35 wt. % alumina binder. It is loaded with 0.6 wt. Pt, based on the total wt. of the catalyst. The zeolite beta is unsteamed.

The support of Catalyst C comprises 65 wt. % USY and 35 wt. % alumina binder. It possesses an alpha value of 25.3, and is loaded with Pt. The zeolite beta is unsteamed.

Catalyst A was first sulfided with a 2% hydrogen sulfide in hydrogen gas mixture according to standard sulfiding procedures. Catalysts B and C were first sulfided with a 400 ppmv hydrogen sulfide in hydrogen gas mixture according to standard sulfiding procedures. Hydrogen gas was then circulated at a target rate equivalent to 4000–7000 SCF/bbl when running at 0.9–1.4 total LHSV, and pressure was set at 390 psig total. The reactor was heated to 300° F. before introducing a hydrocracked kerosene feed. A raw unhydrotreated FCC heavy naphtha was also tested. Feedstock properties are shown in Table 1. The unit was lined out at 60 vol. % conversion to 300° F.- product per pass, with recycle of the on-line still bottoms to extinction. Product properties are shown in Table 2.

The process concept was evaluated by evaluating the performance of Catalyst A, Catalyst B and Catalyst C processing the HDC kerosene. In addition, Catalyst A was evaluated processing raw FCC heavy naphtha.

Figure 2:
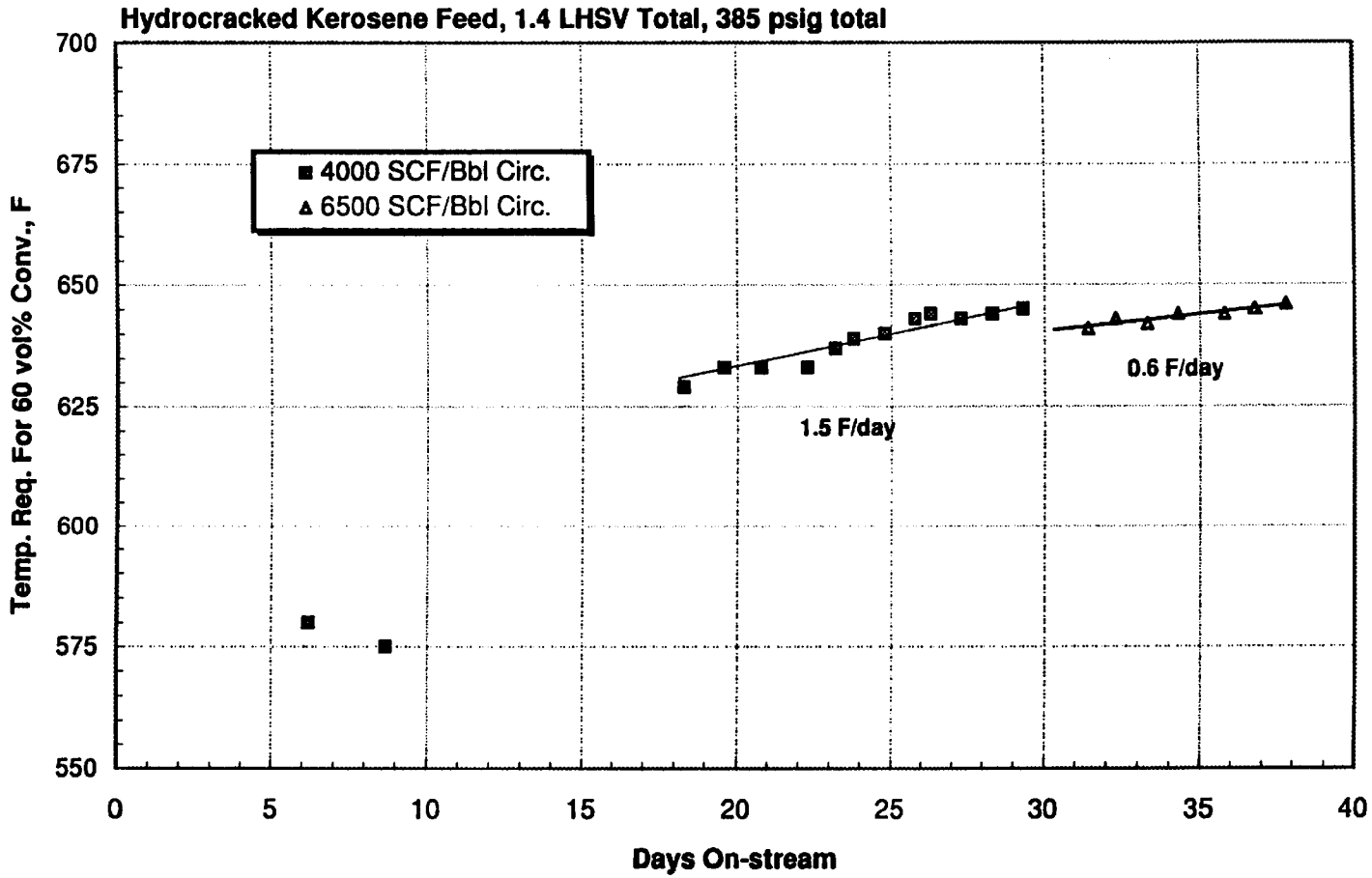
FIG. 2 illustrates the results of a catalyst aging study, employing hydrocracked kerosene feed.

To distinguish the proposed concept from generally accepted views that hydrocracking catalysts such as Pt, Pd or base metal hydrocraking catalysts such as NiW/USY catalysts rapidly age at low reactor pressures, it was important to test catalyst stability. Consequently, the Ni—W pilot unit study was continued for approximately 40 days to measure aging. FIG. 2 shows a plot of catalyst activity as a function of time on-stream. Catalyst A appeared to age rapidly as would be expected during the initial 15 days on-stream but, quite unexpectedly, stabilized to an acceptable aging rate of 0.6° F./day after 30 days on-stream. It is reasonably expected that even lower aging rates can be attained by further optimizing the hydrogen circulation rate. It is further expected that adding a hydrotreating catalyst upstream of the Ni—W USY catalyst could further reduce apparent catalyst aging rate.

Catalysts B and C aging performance was also evaluated and both catalysts aged at less than 0.1° F. per day.

Figure 3:
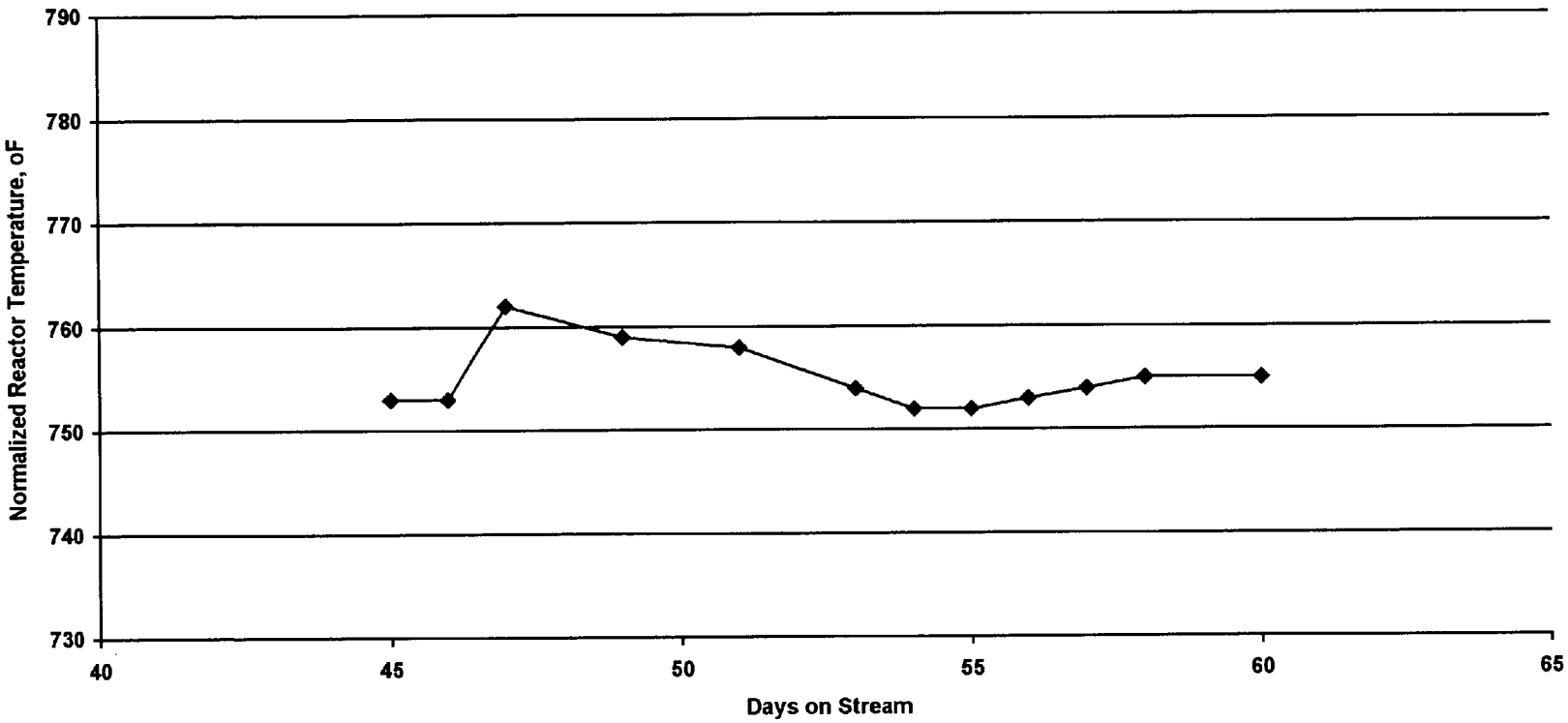
FIG. 3 illustrates the results of a catalyst aging study, employing raw unhydrotreated FCC heavy naphtha.

Flexibility of the current process configuration is demonstrated by the data obtained switching after 40 days on-stream from the hydrocracked kerosene feed to a raw heavy FCC naphtha (Table 1). The FCC naphtha contained only 11.4 wt. % hydrogen compared to 13.4 wt. % hydrogen in the hydrocracked kerosene. As shown in FIG. 3, surprisingly, stable extinction recycle hydrocracking performance is attained, albeit at higher required reactor inlet temperature.

TABLE 1

Feed Properties

| | Feedstock Hydrocracked Kerosene | Feedstock FCC Gasoline |
|---|---|---|
| API | 43.4 | 32.3 |
| S, ppmw | <20 | 6000 |
| N, ppmw | <0.5 | 270 |
| H, wt. % | 13.6 | 11.0 |
| Boiling Range by D2887, ° F. | | |
| IBP | 238 | 244 |
| 10 wt. % | 282 | 293 |
| 30% | 316 | 336 |
| 50% | 335 | 363 |
| 70% | 356 | 396 |
| 90% | 380 | 432 |
| EP | 417 | 479 |
| PNA Analysis, wt. % | | |
| Paraffins | 13.6 | — |
| Naphthenes | 69.1 | — |
| Aromatics | 17.3 | 75 |

TABLE 2

Product Properties

| | Catalyst | | | |
|---|---|---|---|---|
| | A | A | B | C |
| Feedstock | HDC Kero | FCC Heavy Naphtha | HDC Kero | HDC Kero |
| Pilot Unit Conditions | | | | |
| Total LHSV | 1.4 | 0.91 | 1.4 | 1.4 |

TABLE 2-continued

Product Properties

| | Catalyst | | | |
|---|---|---|---|---|
| | A | A | B | C |
| Total Pressure, psig | 385 | 387 | 385 | 385 |
| Hydrogen Pressure at Rx Inlet, psig | 335 | 337 | 335 | 335 |
| Rx Temperature, ° F. | 640 | 741 | 520 | 550 |
| Gas Circulation, SCF/bbl | 6500 | 7400 | 4000 | 4000 |
| Conv. to 300° F. W/recycle to Extinction | 60 | 60 | 60 | 60 |
| Product Yields wt. % | | | | |
| C1 + C2 | 1.45 | 5.83 | 0.04 | 0.17 |
| C3 | 4.94 | 9.31 | 2.54 | 2.83 |
| iC4 | 16.39 | 12.14 | 22.68 | 15.81 |
| nC4 | 4.17 | 6.78 | 1.91 | 2.79 |
| C5 – 300° F. | 74.61 | 69.61 | 74.87 | 78.93 |
| 300° F+ | 0.00 | 0.00 | 0.00 | 1.3 |
| H2 Consumption, SCF/bbl | 900 | 2150 | 1050 | 976 |
| C4 selectivity, % | 20 | 19 | 25 | 18 |
| C5 – 300° F. Selectivity, % | 75 | 70 | 75 | 79 |
| C5 + Aromatics, wt. % | 15 | 45 | — | — |
| C5 + Gasoline Properties | | | | |
| R + 0 | 85.5 | 93.0 | — | — |
| M + 0 | 79.9 | 84.4 | — | — |
| R + M/2 | 82.7 | 88.7 | 82.5 | 71.5 |

What is claimed is:

1. A hydrocracking process for converting a heavy hydrocarbon feed to a lighter fraction having a 300° F. end point, the process comprising:

feeding a heavy hydrocarbon feed and hydrogen in a fixed catalyst bed comprising a hydrocracking catalyst comprising a large pore zeolite catalyst loaded with a metal selected from the group consisting of noble metals and transition metals, said heavy hydrocarbon feed having a boiling point range from about 200° F. to about 900° F. and comprising at least 13 percent by weight hydrogen, less than 2 percent by weight heteroatoms, and less than 40 percent by weight aromatics;

hydrocracking said heavy hydrocarbon feed at a hydrogen partial pressure of from about 300 to about 540 psig to convert the heavy hydrocarbon feed to a lighter fraction having a boiling end point of less than about 300° F. and a heavy fraction;

separating said lighter fraction from said heavy fraction;

recovering said lighter fraction as product; and recycling said heavy fraction to said fixed catalyst bed to substantially convert all of said heavy fraction to a lighter fraction having a boiling end point of less than about 300° F.;

wherein said hydrocracking catalyst stabilizes to an aging rate of less than about 0.6° F. per day after 30 days on stream.

2. The hydrocracking process of claim 1, wherein said heavy hydrocarbon feed is selected from the group consisting of naphtha, kerosene, and diesel fractions.

3. The hydrocracking process of claim 1, wherein said catalyst bed further comprises a hydrotreating catalyst.

4. The hydrocracking process of claim 1, wherein the large pore zeolite is selected from the group consisting of zeolites X, Y, USY, beta, REX, REY, mordenite, ZSM-4, ZSM-20, ZSM-12, ZSM-38 and ZSM-50.

5. The hydrocracking process of claim 1, wherein the large pore zeolite is selected from the group consisting of X, Y, USY, and beta zeolites.

6. The hydrocracking process of claim 1, wherein the catalyst bed further comprises a base metal.

7. The hydrocracking process of claim 1, wherein the hydrocracking catalyst stabilizes to an aging rate of less than about 0.1° F. per day after 30 days on stream.

8. The hydrocracking process of claim 1, wherein the large pore zeolite has a constraint index of less than about 2.

9. The hydrocracking process of claim 1, wherein the large pore zeolite has a constraint index of less than about 2 and at least one noble metal or transition metal in combination with Mo, W or combinations thereof.

* * * * *